US005959233A

United States Patent [19]

Garcia et al.

[11] Patent Number: 5,959,233

[45] Date of Patent: Sep. 28, 1999

[54] LINE CHARGE FASTENER AND DETONATING CORD GUIDE

[75] Inventors: Felipe Garcia, Panama City; Robert Woodall, Lynn Haven; Gilberto Irizarry, Panama City Beach, all of Fla.

[73] Assignee: The United States of America as represented by the Secretary of the Navy, Washington, D.C.

[21] Appl. No.: 09/034,772

[22] Filed: Mar. 2, 1998

Related U.S. Application Data

[63] Continuation-in-part of application No. 09/012,932, Jan. 24, 1998, application No. 08/944,049, Sep. 12, 1997, and application No. 09/030,518, Feb. 17, 1998.

[51] Int. Cl.[6] ..... B64D 1/04; F42B 7/02

[52] U.S. Cl. ..... 89/1.13; 102/403; 89/1.11

[58] Field of Search ..... 89/1.13, 1.11; 102/282; 285/178

[56] References Cited

U.S. PATENT DOCUMENTS

| | | | |
|---|---|---|---|
| 3,114,316 | 12/1963 | Littleton | 89/1.13 |
| 3,750,604 | 8/1973 | Carrel et al. | 112/265 |
| 4,035,872 | 7/1977 | MacBean | 24/31 H |
| 4,298,220 | 11/1981 | Kukuminato | 285/178 |
| 4,497,270 | 2/1985 | Boser | 112/265.2 |
| 4,505,201 | 3/1985 | Abele | 102/324 |
| 4,619,023 | 10/1986 | Tsubokawa | 24/394 |
| 4,711,683 | 12/1987 | Merkatoris | 156/164 |
| 4,827,579 | 5/1989 | Gishbourne | 24/391 |
| 4,911,683 | 3/1990 | Legge et al. . | |
| 4,963,064 | 10/1990 | Peterson | 411/387 |
| 5,063,848 | 11/1991 | Tucker et al. | 102/282 |
| 5,457,855 | 10/1995 | Kenney et al. | 24/445 |
| 5,458,161 | 10/1995 | Scarfe | 139/383 |
| 5,524,524 | 6/1996 | Richards et al. | 89/1.13 |
| 5,659,930 | 8/1997 | Okawa . | |

*Primary Examiner*—Charles T. Jordan
*Assistant Examiner*—Jeffrey Howell
*Attorney, Agent, or Firm*—Harvey A. Gilbert; Donald G. Peck

[57] ABSTRACT

An elongate fabric sleeve functions as the load bearing strength member for a rocket deployed line charge of explosive charges. The fabric sleeve is contoured by seams sewn to form pockets that separate and snugly cradle the explosive charges and to form passageways between adjacent charges which permit free, unhindered motion of a detonating cord in it. The fabric sleeve strength member flexes as the line charge is launched and emplaced to withstand the severe forces associated with deployment of the line charge and prevents damage to the detonating cord to assure reliable deployment and detonation of the explosive charges.

13 Claims, 1 Drawing Sheet

LINE CHARGE FASTENER AND DETONATING CORD GUIDE

CROSS REFERENCE TO RELATED APPLICATIONS

This is a continuation in part of copending U. S. patent applications entitled "Reliable and Effective Line Charge System" by Felipe Garcia et al., U.S. patent Ser. No. 09/012,932 (NC 78,433), filed Jan. 24, 1998, "Line Charge Insensitive Munition Warhead" by Felipe Garcia et al., U.S. patent Ser. No. 08/944,049 (NC 78,448), filed Sep. 12, 1997, and "Line Charge Connector" by Felipe Garcia et al., Ser. No. 09/030,518 (Navy Case Number 78,635), filed Feb. 17, 1998 and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to deployable munitions. In particular, this invention relates to a fabric strength member for a line charge of explosive charges used to clear mines and obstacles that is contoured to hold the explosive charges and withstand severe deployment forces while not engaging a common detonating cord. This prevents damage to detonation components and assures reliable deployment of the explosive charges.

Over the years systems have evolved for clearing anti-personnel obstacles and mines from narrow passageways or lanes. Usually, a path is cleared with different explosive devices, such as the bangalore torpedo. Although it is claimed to be portable, the rigid bangalore torpedo is heavy and bulky and, during deployment, it exposes the firing team to enemy fire for extended periods. Other systems for breaching obstacles with explosives might tear-apart or malfunction during deployment, be inadequate for the task, or elevate the risks of explosive mishaps to undesirable and unacceptable levels.

An improvement over conventional breaching systems is the above referenced rocket deployable line charge. This line charge has a series of spaced-apart warheads, or explosive charges such as those referred to above. Each warhead is individually clamped to a plurality of cord-like strength members and a detonating cord freely extends through axial bores in the warheads. A rocket motor at one end of the strength members is connected to the line charge via a connector such as that referred to above. The rocket motor pulls the line charge across an obstacle laden area. The cord-like strength members provide strain management to withstand the severe deployment forces and to preclude damage to the detonating cord. However, each warhead is individually secured to each cord of the strength members by one or more clamps or other fasteners. In addition, each clamp or fastener must be appropriately tightened within limits that suitably hold each warhead on the cords, yet does not severely crimp or crush the cords to such an extent that it weakens or otherwise causes their structural failure. Consequently, the assembly and adjustment procedure is labor-intensive and time-consuming to such an extent that it may compromise the overall effectiveness of the line charge.

Thus, in accordance with this inventive concept, a need has been recognized in the state of the art for an elongate fabric strength member that is contoured to hold and separate explosive charges, withstands severe deployment forces, and provides for free movement by a detonating cord to assure reliable deployment of the line charge and detonation of its explosive charges.

SUMMARY OF THE INVENTION

The present invention is directed to providing a line charge having an elongate fabric sleeve that separates and cradles a plurality of explosive charges. The fabric sleeve withstands severe deployment forces and permits free passage of a detonating cord in it to assure deployment and detonation of the explosive charges.

An object of the invention is to create a contoured fabric strength member cradling explosives in launched line charges.

Another object of the invention is to provide contoured fabric that cradles explosive charges in proper alignment and spacing and provides strain relief for a detonating cord in rocket deployable line charge systems.

Another object of the invention is to provide contoured fabric holding explosive charges in rocket deployable line charge systems that absorbs different strains via various fabric and weave compositions.

Another object of the invention is to provide contoured fabric holding explosives in a rocket deployable line charge that reduces system weight by using a single structural element that simplifies fabrication of the line charge.

Another object of the invention is to provide a rocket deployable line charge that cradles explosive charges in a contoured fabric sleeve to allow higher launch loads without clamps or other securing devices.

Another object of the invention is to provide a rocket deployable line charge capable of sustaining increased launch loads by cradling the explosive charges in a contoured fabric sleeve that has greater areas of surface contact as compared to the cords that are clamped to the explosives in the prior art.

Another object of the invention is to provide a rocket deployable line charge cradling explosive charges in a contoured fabric sleeve to deploy line charges by more powerful rocket motors from greater and safer standoff distances.

Another object of the invention is to provide a cost effective rocket deployable line charge.

Another object of the invention is to provide a rocket deployable line charge cradling explosive charges in a contoured elastic fabric sleeve to absorb strains during deployment.

These and other objects of the invention will become more readily apparent from the ensuing specification when taken in conjunction with the appended claims.

DESCRIPTION OF THE PREFERRED EMBODIMENT

Figure 1:
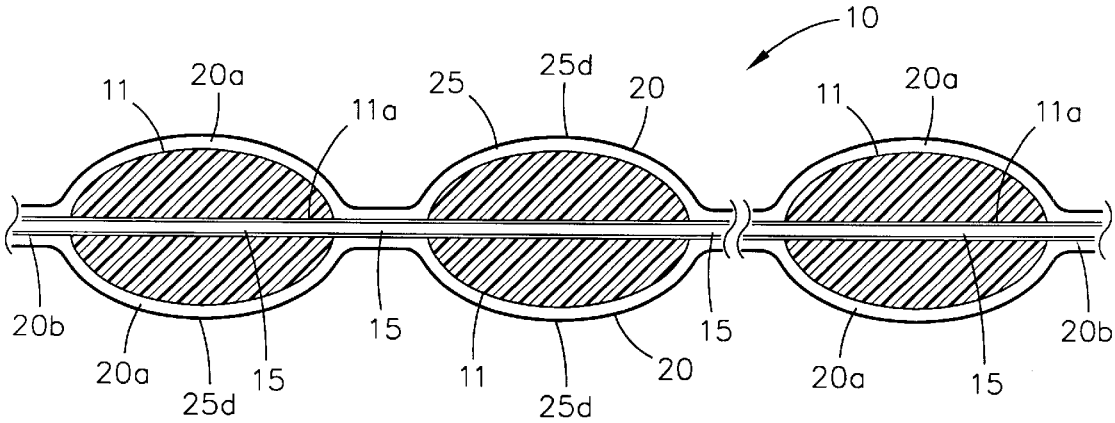
FIG. 1 cross-sectionally shows the invention cradling explosive charges and detonating cord in a rocket deployable line charge.
Figure 3:
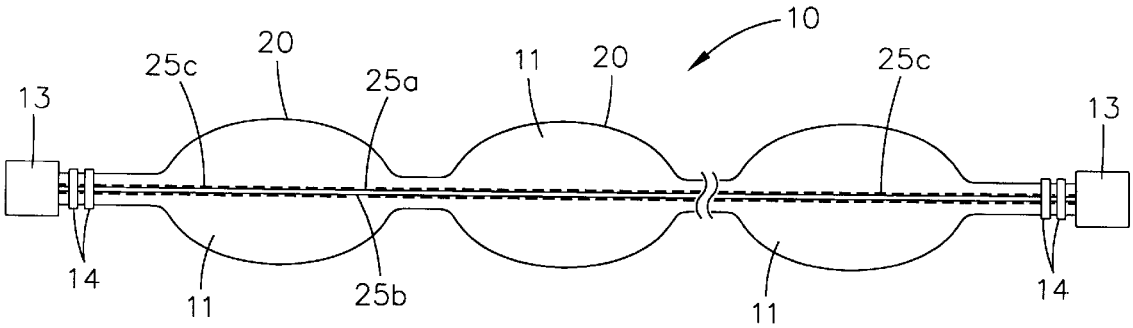
FIG. 3 shows a line charge having explosive charges and detonating cord cradled in a contoured fabric strength member extending between connectors according to this invention.

Referring to FIGS. 1 and 3 of the drawings, a portion of line charge 10 has several explosive charges or warheads 11 for clearing away obstacles and mines. A common detonating cord 15 extends through bores 11*a* in all of explosive charges 11 to simultaneously explode when detonation cord 15 is detonated. Only a few explosive charges 11 are shown in the drawings for the purposes of demonstrating this inventive concept. It is to be understood that many explosive charges 11 could be included in line charge 10. In addition, several sections of such line charges could be coupled together by connectors 13 when more explosives are needed to accomplish the mission.

Line charge 10 is emplaced by a firing team and deployed by a rocket which pulls it across the designated area. Other methods for deploying line charge 10 could be used, such as towing, parachute laying, catapulting, and air gunning. After line charge 10 rests on the area, a suitable detonator, or fuze assembly detonates it via detonating cord 15 that is common to all explosive charges 11.

Axial bore lla in each explosive charge 11 is sufficiently sized to slidably receive detonating cord 15 through it. Consequently, detonating cord 15 is free to slide or reciprocally move through each explosive charge 11 without being subjected to the failure inducing strains associated with launch. In other words, detonating cord 15 is not secured to nor does not otherwise engage explosive charges 11 but is located in close enough proximity to the explosive in each explosive charge 11 to assure virtually simultaneous detonation of all of explosive charges 11 when it is detonated. Details of line charge 10 and the constituents explosive charge 11 and detonating cord 15 are explained in greater detail in the above referenced copending line charge system and munition warhead.

Connectors 13 at opposite ends of line charge 10 either secure it to a rocket motor, another line charge 10, or a tether or anchor, see FIG. 3. Connector 13 may be similar to the structure described in the above referenced copending connector and has clamps 14 for engaging line charge 10 as explained below.

Line charge 10 further includes contoured fabric sleeve 20 that serves as the strength member that bears the loads created during deployment. Fabric sleeve 20 is appropriately contoured with pockets 20*a* to cradle and separate explosive charges 11 along the length of line charge 10, and passageways 20*b* for guiding detonating cord 15. Contoured fabric sleeve 20 may be fabricated from many different fabrics that are woven in many well-known ways to cradle, or secure explosive charges 11.

Figure 2:
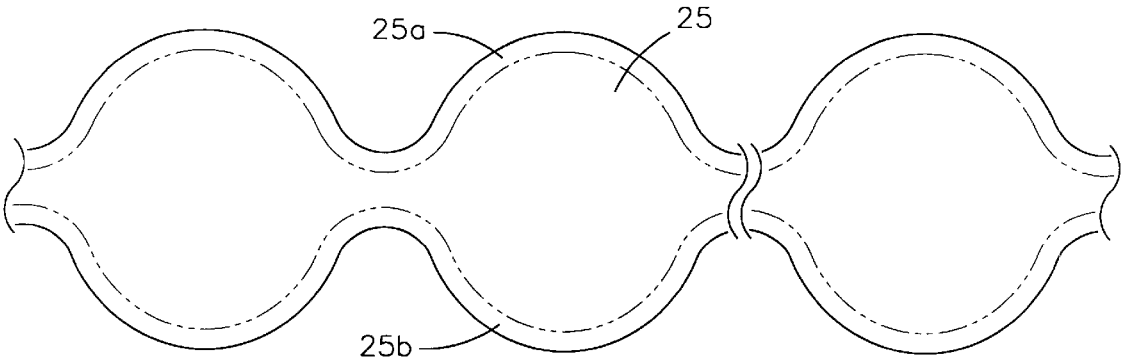
FIG. 2 shows a typical configuration of one exemplary fabric panel of the fabric strength member of this invention.

FIG. 2 shows a typical nylon fabric panel 25 that is suitably contoured to function as the strength member (contoured fabric sleeve 20 in FIGS. 1 and 3) for the line charge. Explosive charges 11 and detonating cord 15 are placed on fabric panel 25. Opposite sides of fabric panel 25 are folded together so that strips 25*a* and 25*b* located at the opposite sides contiguously abut each another. Then, strips 25*a* and 25*b* are sewn together in seam 25*c* that extends along the perimeter created by folding fabric panel 25, see FIG. 3. Seam 25*c* preferably might be the inherently stronger multi thread seam, or over-locked seam, created by a serger type sewing machine, for example. Sewing strips 25*a* and 25*b* together in seam 25*c* creates a sleeve-shaped, contoured fabric strength member 20 in accordance with this invention. Separate pockets 20*a* snugly fit around explosive charges 11 to cradle separate explosive charges 11 in separate pockets 20*a* spaced apart from each other. The separation between adjacent explosive charges 11 is within a critical dimension, or spacing that assures effectiveness of line charge 10 to accomplish the mission when it is detonated. In other words, in addition to cradling explosive charges 11 during deployment, contoured fabric strength member 20 also maintains this critical effectiveness spacing.

Seam 25*c* also is sewn to create sufficiently sized passageways 20*b* extending between adjacent explosive charges 11 in pockets 20*a* to permit free longitudinal motion of detonating cord 15 in it. The fabric along passageway 20*b* does not grip or exert objectionable frictional forces on detonating cord 15 but instead guides it and prevents kinks from developing.

The sleeve-shaped, contoured, fabric strength member 20 is connected at its opposite ends to connector 13 by band clamps 14 or other means for securing, such as straps, bonding agents, etc. As mentioned above, each connector 13 may be joined to a rocket motor, another line charge 10, a tether, anchor or whatever else is called for by the tactical situation.

Another technique for shaping and constructing contoured fabric sleeve 20 has a pair of panels 25 cut to be mirror images of each other and sized to contain explosive charges 11 and detonating cord 15. These mirror-image panels 25 could be brought together to sandwich pockets 20*a* that contain and snugly fit around explosive charges 11 with detonating cord 15 extending in passageways 20*b* between them. Sewing strip 25*a* from one mirror image panel to strip 25*a* from the other mirror image panel and similarly sewing strips 25*b* together form seams 25*d* on opposite sides of mirror image panels 25, see FIG. 1; only one panel 25 of fabric sleeve 20 is shown. Seams 20*d* thereby create separate pockets 20*a* in contoured fabric sleeve 20 to bear deployment loads and to space explosive charges 11 apart.

Another design for contoured fabric sleeve 20 has fabric woven in a tubular shape. Tubularly-shaped fabric sleeve 20 would have dimensions which fit snugly around the outer surface of each explosive charge 11 and would need only a tuck taken-in at opposite ends of each explosive charge 11 to form each pocket 25*a* and passageway 25*b*. This contoured sleeve would be quite similar in appearance to the sleeves shown in FIGS. 1 and 3.

The sleeves described herein also could have several layers stacked and sewn together. Layered sleeves have more strength for bearing the loads created when longer line charges or bigger explosive charges are deployed.

The sleeves can be made from numerous natural and manmade fibers that are woven together in many different patterns. These sleeves are capable of stretching and withstanding the severe strains which are characteristic of the deployment of line charges 10. For example, the manmade fibers manufactured under the Trademarks Nylon, Kevlar, Nomax, etc. to name a few, might be chosen. Natural fibers, such as cotton, linen, etc. also might be selected. Combinations of such fibers also are envisioned within the purview of this invention. The fibers and fabrics allow stretching (energy absorption) upon launch, relaxation upon landing, provide for explosive charge fastening, and allow detonating cord 15 to be cradled and relieved of strain throughout line charge 10. The threads used to sew the seams could also be manmade fibers made under the Trademarks Nylon, Kevlar, Nomax, etc. or natural fibers like cotton, linen, etc.

In addition to sewing, other means are available for shaping and otherwise fastening the pockets 20*a* and passageways 20*b* of the fabric sleeve 20. For example, the fastener described in U.S. Pat. No. 5,659,930 is a surface type fastener having a thick foundation fabric running the entire length of the line charge fabric sleeve. Another fastener is described in U.S. Pat. No. 5,457,855 and has a woven self engaging fastener that might run the entire length of line charge 10. Another fabric fastener, described in U.S. Pat. No. 4,963,064, is pushed through each side of the fabric at regular (1 to 4 inch) intervals and secured by threading on a wide flange nut from the bottom end of the fabric fastener. Yet another slide fastener that could be used is detailed in U.S. Pat. No. 4,619,023 and could run the entire length of the fabric sleeve of line charge 10. The method of closing fabrics disclosed in U.S. Pat. No. 4,035,872 is still another choice since it aligns and intermeshes heavy fabric loops on each edge of the fabric sleeve, and a wire is inserted between the loop array. This will hold the fabric sleeve securely over the entire length of the fabric sleeve of line charge 10. Other well known fasteners for forming pockets 20*a* and passageways 20*b* might be properly located zippers; fasteners such as those marketed under the trademark Velcro; bonding agents such as those marketed under the trade name Epoxy; glues; and thermosetting action of the fabric sleeve material of the strength member along an overlapped seam along the length of line charge 10. Furthermore, the strength of the seam using any of the abovementioned fastening techniques may be augmented by inserting glue, Epoxy, and thermosetting or adding thermoplastic polymers/adhesives along the entire fabric seam and activating them in customary fashion.

The invention herein discloses contoured fabric sleeve 20 cradling explosive charges 11 and allowing free motion of detonating cord 15. Sleeve 20 functions as the strength member suitable for use in rocket deployable line charge systems and less severe deployment environs. Fabric contours over explosive charges 11 and provides for their secure positioning and cradling. The fabric stretches to absorb the excessive loading attributed to launching line charge 10 via rocket or mortar. The tailored, snugly fitting contoured sleeve 20, made from any one or more of a variety of materials in an infinite variety of weaves, fastens explosive charges 11 at spaced intervals. Simultaneously, sleeve 20 provides a strain relieved area for cradling detonating cord 15 and preventing failure inducing strains from reaching it.

In accordance with this invention, contoured fabric sleeve 20 conforms to, encompasses, and holds explosive charges 11 in pockets 20*a*. Around each properly spaced explosive charge 11, the structural fabric is tailored or folded and, where the two sides of the pattern meet, it is fastened together. Detonating cord 15 is placed to extend through hollow bores lla in explosive charges 11 prior to folding and fastening the fabric together. Opposite ends of line charge 10 are secured to connectors 13 via bands 14 engaging contoured fabric sleeve 20.

Ends of detonating cord optionally are secured in connectors 13 and additional lengths of detonating cord 15 are placed in passageways 20*b* of contoured fabric sleeve 20 so that the overall length of detonating cord 15 is longer than contoured fabric sleeve 20. Consequently, when line charge 10 is launched, or deployed, loads are transmitted exclusively through the strength member, contoured fabric sleeve 20, that surrounds and holds explosive charges 11, and not through the more delicate detonating cord 15. Anchorage of the components of line charge 10 in the fashion herein disclosed causes virtually all energy transmitted to line charge 10 at launch to be absorbed by the outer fabric strength member 20. Stretching of the weaker detonating cord 15 is minimized, and detonation is assured.

The elasticity of contoured fabric sleeve 20 allows line charge 10 to stretch throughout its length and circumference upon launch and return to its original extension upon landing. This effectively limits the peak acceleration of explosive charges 11 by spreading the launch forces over a longer interval. Upon landing, elastic properties of contoured fabric sleeve 20 allow line charge 10 to relax and return explosive charges 11 to their original separation to assure maximum effectiveness.

Because explosive charges 11 are held, or cradled internally by contoured outer fabric sleeve 20, higher launch loads and more reliable spacing of explosive charges 11 are possible without the need for additional clamps or other devices. This is because contoured fabric sleeve 20 has greater surface contact with explosive charges 11, as compared to external cords, or ropes of the prior art. This surface contact prevents motion by detonating cord 15 due to slippage and/or fabric material yield.

Accordingly, having line charge 11 fabricated in accordance with this invention allows more energy to be absorbed by the strength member (contoured fabric sleeve 20) prior to structural failure. Thus, more powerful rocket motors can deploy line charge 10 from greater and safer standoff distances. In addition, longer line charges can be deployed by rockets since they can survive the increased loading created by the greater entrained weights. Furthermore, line charges 10 fabricated in accordance with this invention are easier and cheaper to manufacture since they are less complicated and less time consuming to assemble.

The components of line charges 10 might be altered to perform different tasks other than delivering explosive charges for obstacle clearing and breaching applications. However, such alterations are within the scope of this invention. For example, this technology could be used to couple other components in addition to explosive charge components for remote deployment. A line array of components, such as seismic sensors, hydrophones, electronic devices, medical supplies, water and/or food modules could also be cradled in pockets 20*a* of contoured flexible sleeve 20 and deployed where needed by a variety of different means. Enabling lines other than detonating cord 15 extend between the components. These lines may be, power cables, fluid tubes, or other umbilical lines which could be included to freely slide, pass, or feed through passageways 20*b* as needed. Therefore, still other uses and modifications of this inventive concept are foreseen to better accommodate different mission requirements without departing from the scope of this invention.

In addition, having this disclosure in mind, one skilled in the art to which this invention pertains will select and assemble suitable fabrics with various assembly techniques from among a wide variety available in the art. Therefore, this disclosure is not to be construed as limiting, but rather, is intended to demonstrate this inventive concept.

It should be readily understood that many modifications and variations of the present invention are possible within the purview of the claimed invention. It is to be understood that within the scope of the appended claims the invention may be practiced otherwise than as specifically described.

We claim:

1. A line charge comprising:

a plurality of explosive charges each having outer lateral rounded contours and a bore extending therethrough;

an elongate fabric sleeve formed from one fabric panel having a plurality of longitudinally disposed pockets each shaped to snugly fit around said outer lateral rounded contours to cradle a separate one of said plurality of explosive charges therein and a plurality of passageways each extending between adjacent pockets; and detonating cord extending through said bores and through said passageways between adjacent explosive charges, said bores and passageways being sized to permit said detonating cord to longitudinally slide freely therethrough.

2. A line charge according to claim 1 in which said fabric sleeve flexes during deployment of said explosive charges to withstand forces created during said deployment and said bores and said passageways permit said detonating cord to longitudinally slide freely therein during flexure of said fabric sleeve to prevent damage to said detonating cord.

3. A line charge according to claim 2 further comprising:

a connector secured to each end of said fabric sleeve, one connector being adapted to be connected to a rocket motor.

4. A line charge according to claim 3 in which said fabric sleeve is a tubularly-shaped sleeve formed to define said pockets and passageways.

5. A line charge according to claim 4 further comprising:

seams sewn in said fabric sleeve to contour said pockets to snugly fit around and cradle said outer lateral rounded contours and to define said passageways between said explosive charges.

6. A line charge according to claim 2 further comprising:

fasteners disposed in said fabric sleeve to engage said fabric sleeve and form said pockets and said passageways therein, said fasteners are selected from the group of fabric fasteners consisting of seams sewn in said fabric sleeve, slide fasteners in said fabric sleeve, surface type fasteners having thick foundation fabrics in said fabric sleeve, woven self engaging fasteners in said fabric sleeve, flanged fabric fasteners in said fabric sleeve, and intermeshed heavy fabric loop in said fabric sleeve to contour said pockets and said passageways.

7. A line charge according to claim 1 further comprising:

another fabric panel formed with said one panel to define said pockets and passageways.

8. A line charge according to claim 7 further comprising:

seams sewn in said fabric sleeve to contour said pockets to snugly fit around and cradle said outer lateral rounded contours and to define said passageways.

9. A line charge according to claim 1 further comprising:

seams sewn in said fabric sleeve to contour said pockets to snugly fit around and cradle said outer lateral rounded contours and to define said passageways.

10. A method of fabricating a line charge comprising the steps of:

contouring an elongate fabric sleeve with a plurality of pockets serially arranged along the length thereof and with a plurality of passageways each extending between adjacent pockets, said pockets each being configured to snugly fit around outer lateral rounded contours of an explosive charge therein;

cradling a separate explosive charge in each pocket; and extending detonating cord through a bore in each explosive charge and each of said passageways, said bore in each explosive charge and said passageways being sized to permit said detonating cord to longitudinally slide freely therethrough.

11. A method according to claim 10 in which said step of contouring includes sewing seams in said fabric sleeve to contour each pocket to snugly fit around said outer lateral rounded contours of each explosive charge.

12. A line array of components comprising:

means containing components each having outer lateral rounded contours for cradling and spacing said components therein to withstand deployment forces;

means secured to said cradling and spacing means and extending between adjacent explosive charges for permitting free passage of an enabling line between said components therein; and means secured to said cradling and spacing means and said permitting means for connecting said components to a rocket motor, said cradling and spacing means and said permitting means being included in a fabric sleeve contoured to define pockets that each snugly fits around said outer lateral rounded contours to cradle one of said components and passageways that each extend between adjacent ones of said pockets to permit said free passage of said enabling line therein.

13. A line charge according to claim 12 in which said connecting means engages said fabric sleeve with at least one clamp ring to transfer deployment loads to the rocket to assure reliable deployment of said components.

* * * * *